US008262413B2

(12) United States Patent
Fujiwara et al.

(10) Patent No.: US 8,262,413 B2
(45) Date of Patent: Sep. 11, 2012

(54) SHIELD CONNECTOR

(75) Inventors: Michiyo Fujiwara, Yokkaichi (JP); Masaki Okamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 19 days.

(21) Appl. No.: 13/017,121

(22) Filed: Jan. 31, 2011

(65) Prior Publication Data

US 2011/0195603 A1 Aug. 11, 2011

(30) Foreign Application Priority Data

Feb. 5, 2010 (JP) ..... 2010-024165

(51) Int. Cl.
*H01R 13/648* (2006.01)

(52) U.S. Cl. ..... 439/607.28; 439/939

(58) Field of Classification Search ..... 439/607.28, 439/939

See application file for complete search history.

(56) References Cited

U.S. PATENT DOCUMENTS

| | | | | |
|---|---|---|---|---|
| 5,030,140 | A * | 7/1991 | Sugiyama | 439/607.35 |
| 6,554,623 | B2 | 4/2003 | Yoshioka | |
| 7,258,574 | B2 * | 8/2007 | Barringer et al. | 439/607.01 |
| 7,597,587 | B1 * | 10/2009 | Duesterhoeft | 439/545 |
| 7,758,381 | B2 * | 7/2010 | Oki | 439/607.28 |
| 8,096,834 | B2 * | 1/2012 | Lai et al. | 439/607.28 |
| 8,167,634 | B2 * | 5/2012 | Fujiwara et al. | 439/271 |
| 2002/0031949 | A1 * | 3/2002 | Miyazaki | 439/625 |
| 2002/0042228 | A1 | 4/2002 | Yoshioka | |
| 2002/0098737 | A1 * | 7/2002 | Koide et al. | 439/607 |
| 2009/0035993 | A1 | 2/2009 | Okayasu | |
| 2009/0124121 | A1 * | 5/2009 | Matsuoka | 439/550 |

FOREIGN PATENT DOCUMENTS

EP 2105998 A1 3/2009

* cited by examiner

*Primary Examiner* — Renee S Luebke
*Assistant Examiner* — Larisa Tsukerman
(74) *Attorney, Agent, or Firm* — Gerald E. Hespos; Michael J. Porco

(57) ABSTRACT

A shield connector (30) has a housing (40) with a terminal mounting portion (41), a receptacle (55) and a mounting flange (61). Male terminals (31) are mounted in the terminal mounting portion (41) and have tabs that project into the receptacle (55). A shield shell (100) including a shell main body (110) and resilient contact pieces (120) for grounding the shell main body (110) to a mounting member. The resilient contact pieces (120) have leading ends (121) accommodated in accommodating portions (67) formed in the mounting flange (61), and the housing (40) includes protection walls (70) located lateral to the resilient contact pieces (120).

15 Claims, 21 Drawing Sheets

SHIELD CONNECTOR

BACKGROUND OF THE INVENTION

1. Field of the Invention

The invention relates to a shield connector to be mounted on a case of an electrical device.

2. Description of the Related Art

Shield connectors directly connected to metal cases of devices are widely used, for example, in electrical vehicles and the like. A metallic shield shell of a shield connector needs to be grounded to a metal case. U.S. Pat. No. 6,554,623 discloses a structure for grounding a shield shell to a metal case by bringing resilient contact pieces formed on the shield shell into contact with a hole wall of a shaft hole of the metal case. However the resilient contact pieces of the structure shown in U.S. Pat. No. 6,554,623 are mostly exposed to the outside when the connector is left alone. Thus, there is a possibility that the resilient contact piece is caught and damaged or deformed when the connector is carried around or assembled.

The invention was developed in view of the above situation and an object thereof is to provide a shield connector with a protective structure capable of avoiding damage and deformation of a resilient contact piece on a shield shell.

SUMMARY OF THE INVENTION

The invention relates to a shield connector to be mounted onto a conductive mounting member formed with a shaft hole. The shield connector has a housing with a terminal mounting portion and a mounting flange. At least one terminal is to be mounted into the terminal mounting portion. The connector also a conductive shield shell with a substantially tubular shell main body for at least partly surrounding a terminal portion of the terminal and at least one resilient contact piece to be brought resiliently into contact with a surface of the shaft hole of the mounting member to ground the shell main body to the mounting member. The resilient contact piece is in the form of a cantilever folded from the shell main body to extend forward and defining a deformation space between itself and the shell main body. The resilient contact piece has a leading end to be accommodated in an accommodating portion formed in a rear surface of the mounting flange. The housing has at least one protection wall located lateral to the resilient contact piece to at least partly surround and protect a lateral side of the resilient contact piece.

The housing includes a receptacle at a front end for receiving a mating connector from the front. The mounting flange is provided between the terminal mounting portion and the receptacle. The at least one terminal is to be mounted into the terminal mounting portion so that a terminal portion or tab thereof projects into the receptacle.

The resilient contact piece is folded at or near a rear edge portion of the shell main body to extend substantially forward.

The leading end portion of the resilient contact piece is accommodated in the accommodating portion in the mounting flange. Thus, the leading end portion of the resilient contact piece will not be caught by a surrounding interfering object when the shield connector is carried around and assembled. Further, the protection wall surrounds the lateral side of the resilient contact piece. Thus, foreign matter (e.g. leading end of an unlocking jig used to detach the terminal from a cavity) cannot enter into a deformation space for the resilient contact piece.

The protection wall preferably overlaps a top portion of the resilient contact piece. With this construction, foreign matter cannot enter the deformation space for the resilient contact piece.

A contact portion preferably is formed on a top portion of the resilient contact piece and can be brought into contact with the surface of the shaft hole of the mounting member. The contact portion preferably is arcuate entirely or at an end portion. The shield connector may rotate somewhat relative to the shaft hole when a bolt tightening operation is performed to mount the shield connector into the shaft hole of the mounting member. However, with this construction, the contact portion of the resilient contact piece can be held stably in contact with the surface of the shaft hole of the mounting member.

At least one elongated projection is provided on the inner side of the protection wall and projects in to restrict the position of the shell main body and to prevent inclination of the shell main body. Therefore, the resilient contact piece can be held stably in contact with the surface of the mounting member and a high contact pressure of the resilient contact piece with the surface of the shaft hole is ensured.

A taper preferably is formed at or near the rear end of the elongated projection, so that the shield shell can be assembled smoothly into the terminal mounting portion.

A stopper preferably is formed on the shell main body substantially in correspondence with the resilient contact piece to prevent an excessive deformation of the resilient contact piece.

In a mounted position, the shield piece formed on the shell main body preferably projects into the receptacle through one or more communication holes formed in the mounting flange and at least partly surrounds around the terminal.

At least one mounting groove preferably extends around a base portion of the mounting flange and a seal is mounted in the mounting groove. Annular lips preferably are formed on the seal for resiliently contacting a surface adjacent to the shaft hole of the mounting member when the shield connector is mounted on the mounting member.

Plural shield pieces preferably are formed at upper and lower walls of the shell main body at positions substantially facing each other and in a vertically symmetrical relationship, and at a right and left walls of the shell main body at positions substantially facing each other and in a bilaterally symmetrical relationship.

A step preferably is formed at an intermediate position of the shield piece so that a leading end of the shield piece is offset outwardly relative to the base end.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

One preferred embodiment of the invention is described with reference to FIGS. 1 to 20. This embodiment is designed for directly mounting a shield connector 30 on a housing case U of an electrical device (such as an automatic transmission, junction box or the like) that may be mounted in an electrical vehicle. The housing case U is, for example, made of aluminum alloy and is box-shaped. An outer peripheral wall of the housing case U defines a mounting wall 20 on which the shield connector 30 is to be mounted.

Figure 1:
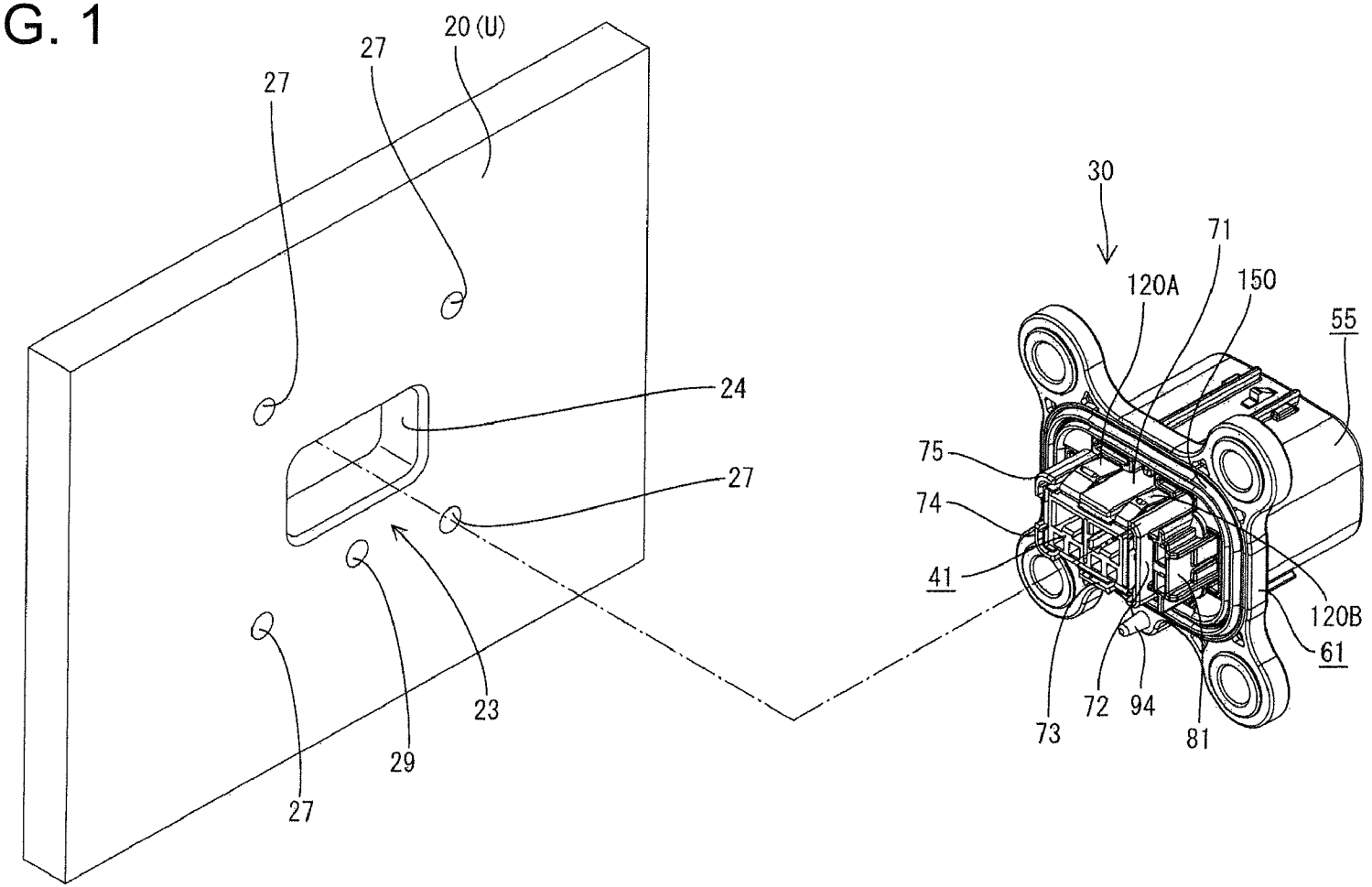
FIG. 1 is a view showing a mounting structure of a shield connector according to one embodiment of the invention.

As shown in FIG. 1, a shaft hole 23 penetrates the mounting wall 20 of the housing case U. The shaft hole 23 defines a wide rectangle with rounded corners. Bolt holes 27 and a positioning hole 29 are formed around the shaft hole 23. The bolt holes 27 are formed at positions substantially corresponding to the corners of the shaft hole 23 and the positioning hole 29 is formed below or at a side of the shaft hole 23.

Figure 3:
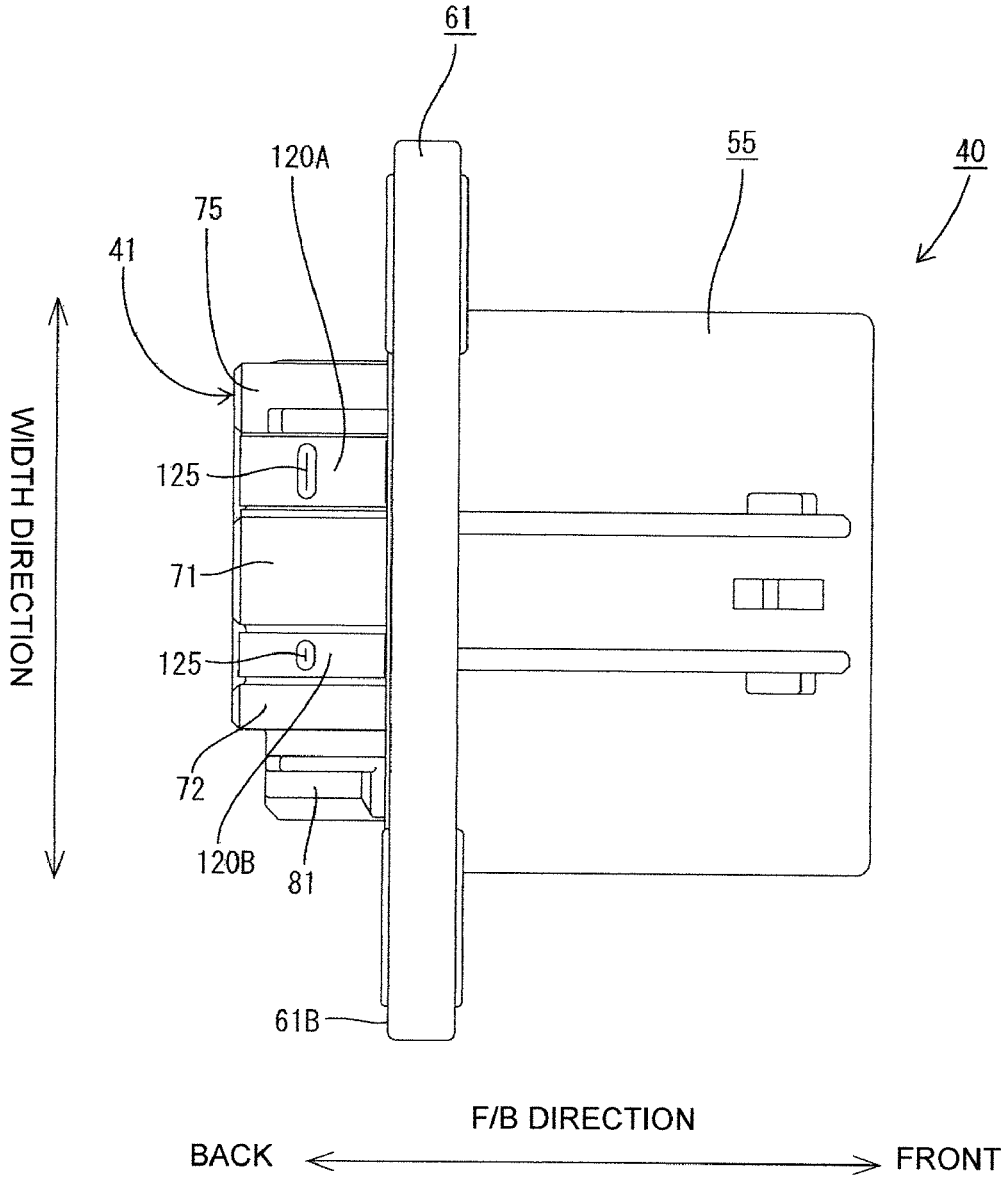
FIG. 3 is a plan view of the shield connector.

In the following description, forward and backward directions refer to a fitting direction into the shaft hole 23 and right and left sides of FIG. 3 are respectively defined as "front" and "rear".

The shield connector 30 includes a housing 40 made e.g. of synthetic resin and formed unitarily with a terminal mounting portion 41, a receptacle 55, a mounting flange 61 and protection walls 70 as shown in FIGS. 2 to 6.

The terminal mounting portion 41 is a wide block with two side by side cavities 42 inside. The cavities 42 are open in a rear end surface 46 of the terminal mounting portion 41 and receive respective male terminals 31 from behind.

Each male terminal 31 is formed by bending a conductive metal plate punched or cut out into a specified developed shape. A tab 32 is provided at a leading end of each male terminal 31 and is electrically connectable to a mating female terminal fitting (not shown). The male terminal 31 is crimped and connected to a core exposed at an end portion of a wire 35.

Front ends of the cavities 42 communicate with the receptacle 55, so that the tabs 32 of the male terminals 31 mounted into the terminal mounting portion 41 project into the receptacle 55.

A locking lance 43 for locking the male terminal 31 is formed at a bottom wall of each cavity 42. The locking lance 43 is resiliently deformable in a direction intersecting an insertion direction of the male terminals 55 into the cavities 42, and a lance deformation space for the locking lance 43 is formed below the locking lance 43.

An auxiliary terminal mounting portion 81 is formed at a side (to the right in FIG. 2) of the terminal mounting portion 41 for accommodating auxiliary terminals for interlock detection. Two auxiliary cavities 82 are formed substantially one above the other for accommodating auxiliary terminals (not shown). Further, contact pieces 85 are formed on the outer wall of the auxiliary terminal mounting portion 81 and extend backward of the housing 40. One contact piece 85 is formed on each of the upper and lower walls of the auxiliary terminal mounting portion 81 and two contact pieces 85 pieces are formed on a right wall of the auxiliary terminal mounting portion 81.

The receptacle 55 has a substantially tubular shape with an open front end for receiving a mating connector (not shown) from the front. A retainer 130 is insertable into the receptacle 55 from the front and includes restricting pieces 132 that are insertable into the respective lance deformation spaces. The restricting pieces 132 enter the lance deformation spaces when the retainer 130 is mounted in the receptacle 55 to prevent deformations of the locking lances 43 in an unlocking direction. The retainer 130 has a partition wall 131 that partitions the two tabs 32 projecting into the receptacle 55.

Figure 4:
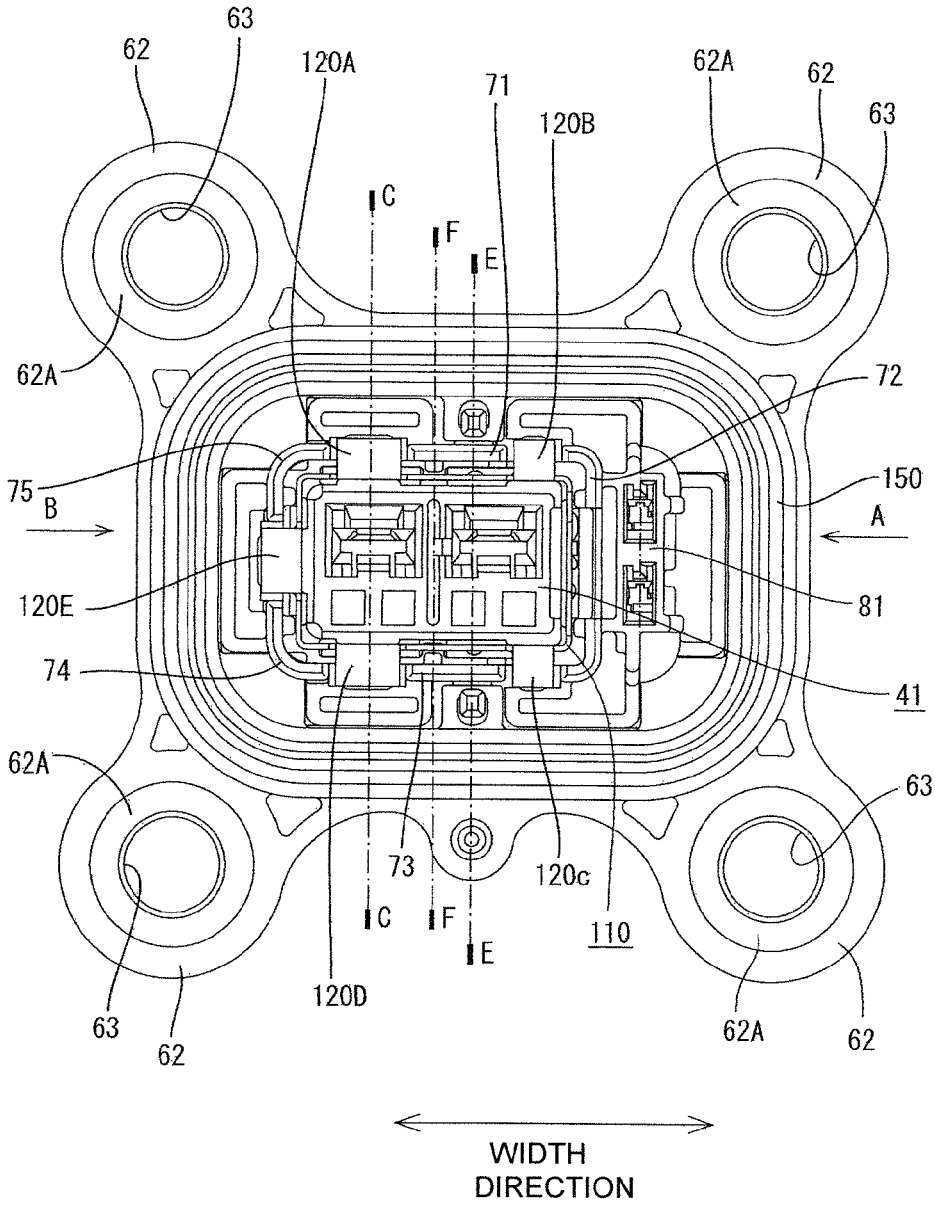
FIG. 4 is a rear view of the shield connector.
Figure 5:
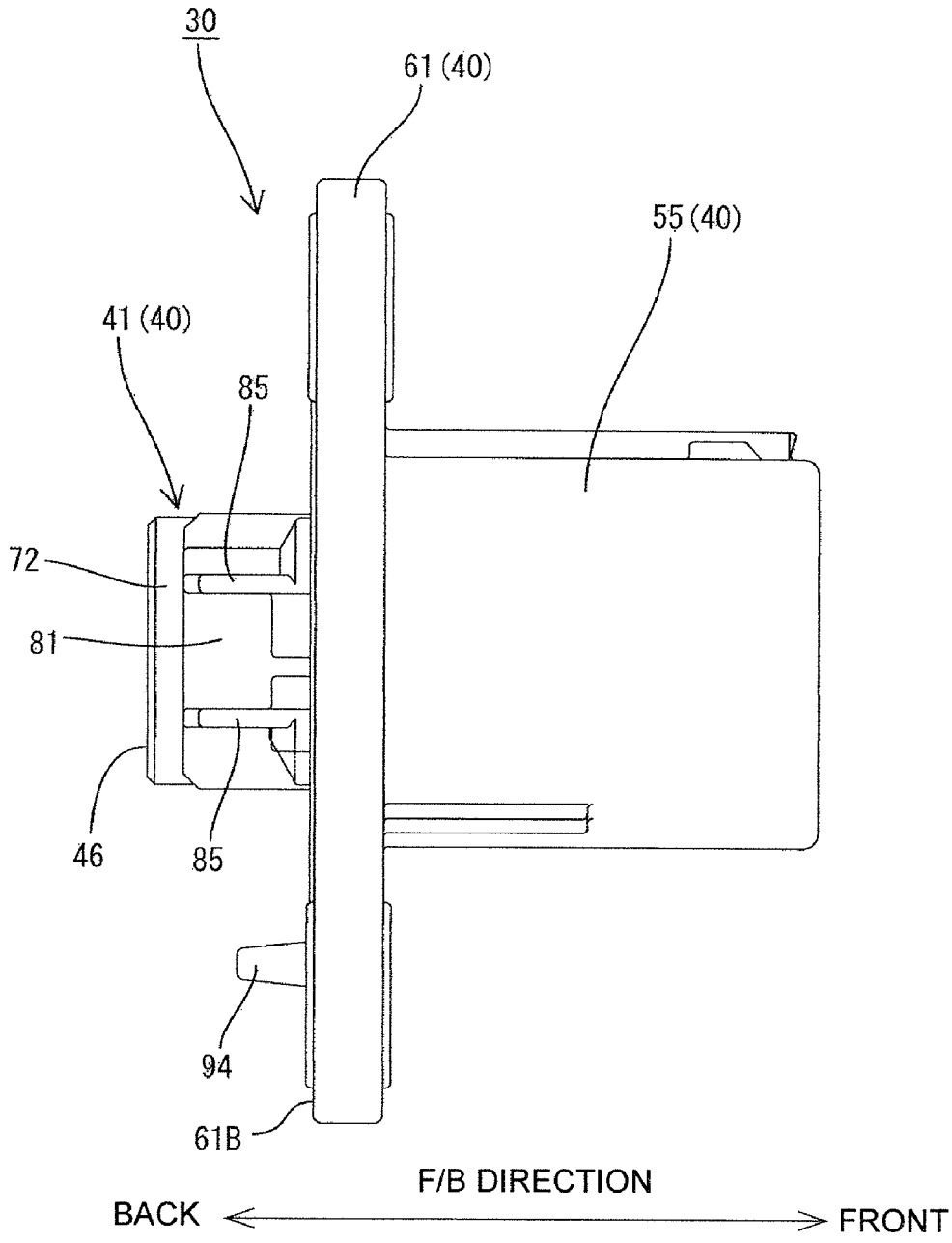
FIG. 5 is a side view of a shield shell when viewed in a direction A of FIG. 4.

The mounting flange 61 projects out between the terminal mounting portion 41 and the receptacle 55. When viewed from behind, the mounting flange 61 has a horizontally wide shape as shown in FIG. 4 and is larger than the shaft hole 23 of the mounting wall 20.

Round fastening seats 92 are formed at the four corners of the mounting flange 61 and each has a conductive metallic collar 92A inserted therein. Bolt insertion holes 93 of these four fastening seats 92 correspond to the respective four bolt holes 27 in the mounting wall 20. The mounting flange 61 also has a positioning boss 94 corresponding to the positioning hole 29 in the mounting wall 20. When the boss 94 is fit into the positioning hole 29 from above, the shield connector 30 is positioned on the mounting wall 20 and the four bolt insertion holes 93 of the shield connector 30 align respectively with the four bolt holes 27 of the mounting wall 20.

The shield shell 100 is made of one conductive metal plate and includes a shell main body 110 and resilient contact pieces 120 (see FIGS. 7 to 11). The shell main body 110 is a substantially rectangular tube and includes shield pieces 115 at its front side. Each shield piece 115 is substantially in the form of a plate and extends substantially horizontally forward. Two beads 117 are formed substantially side by side near a base end of each shield piece 115. Protuberances 118 are formed near a leading end of the each shield piece 115. The protuberances 118 project in and have substantially spherical shapes. Each shield piece 115 is formed with a step at an intermediate position so that the leading end is offset out by as much as the step relative to the base end.

The shield pieces 115 are provided at the four lateral surfaces of the shell main body 110. Specifically, two shield pieces 115 are formed at each of an upper wall 111 and a lower wall 112 of the shell main body 110 and one shield piece is formed at each of a right wall 113 and a left wall 114 of the shell main body 110. In other words, six shield pieces 115 are formed in the entire shield shell 100.

The shield pieces 115 at the upper and lower walls 111 and 112 face each other and are in a vertically symmetrical relationship. Further, the shield pieces 115 formed at the right and left walls 113 and 114 also face each other in a bilaterally symmetrical relationship. The respective shield pieces 115 are inserted through communication holes (see FIG. 13) 69 formed in the mounting flange 61 of the housing 40 to project into the receptacle 55.

Figure 9:
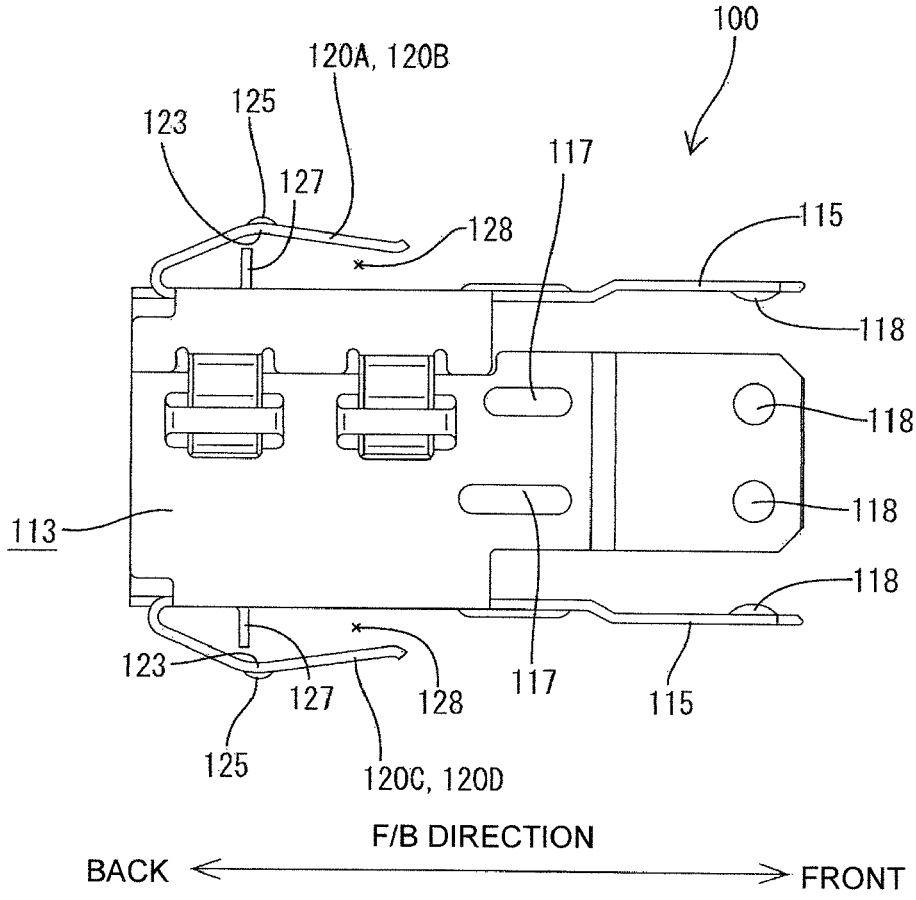
FIG. 9 is a side view of the shield shell when viewed in a direction A of FIG. 8.
Figure 10:
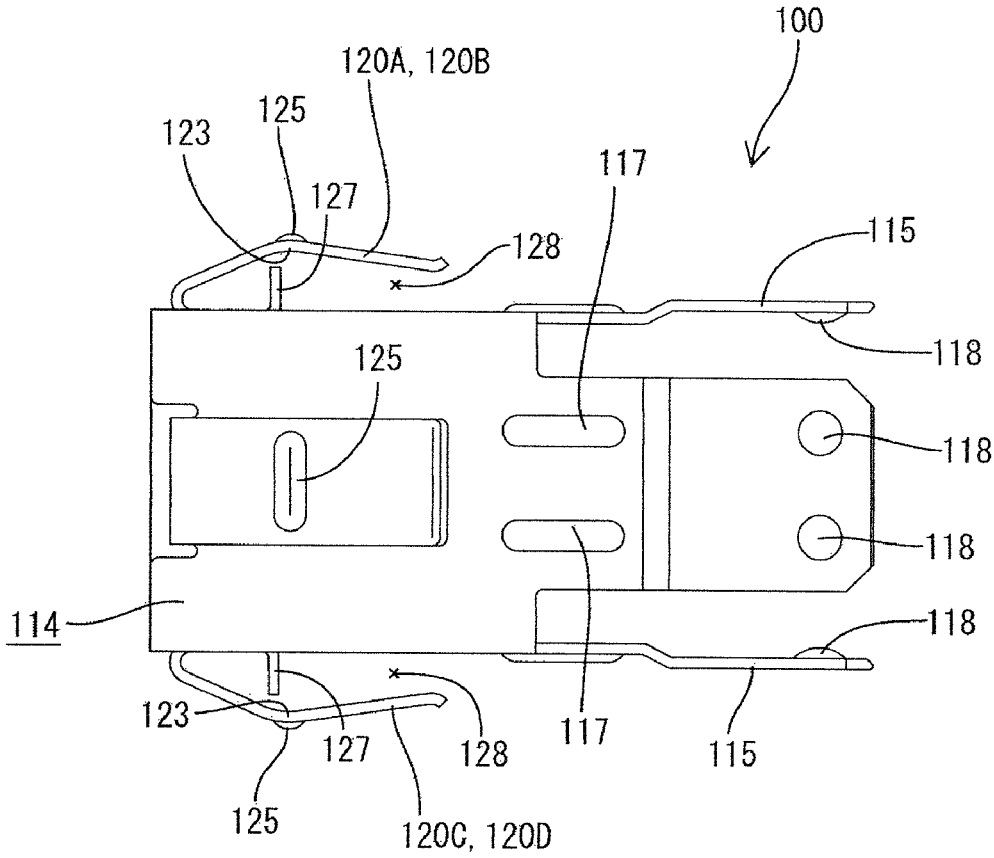
FIG. 10 is a side view of the shield shell when viewed in a direction B of FIG. 8.
Figure 11:
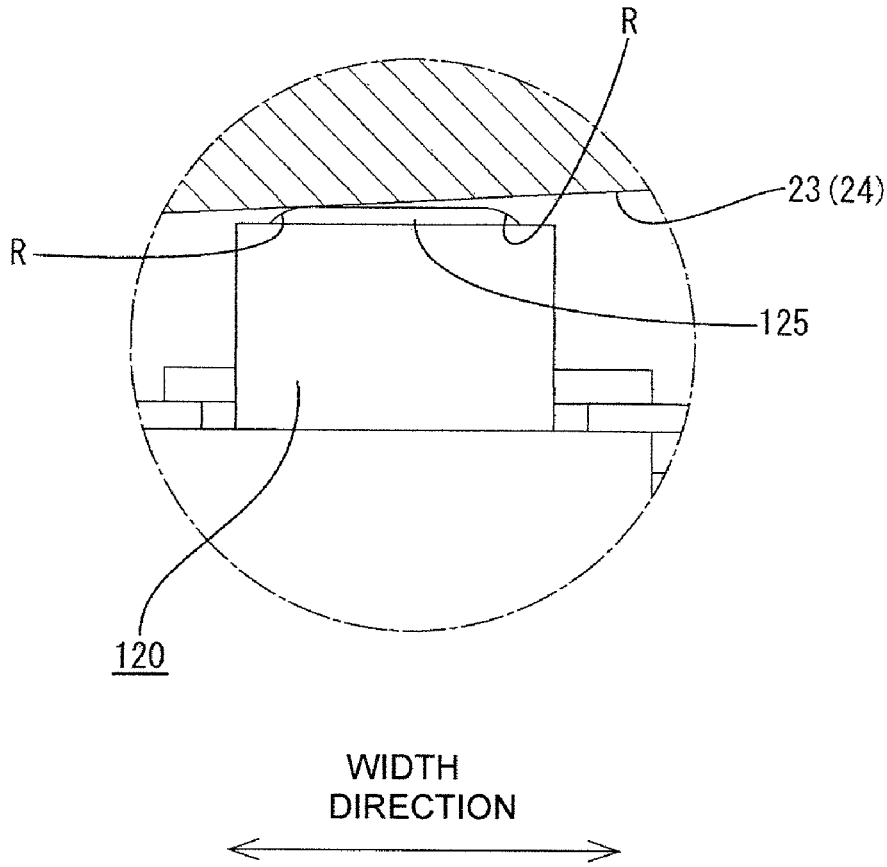
FIG. 11 is an enlarged view enlargedly showing a part D of FIG. 8 (diagram showing the shape of a contact portion).

The resilient contact pieces 120 are U-turned to extend forward at the rear edge of the shell main body 110 while defining deformation spaces 128 between themselves and the shell main body 110. Each resilient contact piece 120 is substantially arched as shown in FIGS. 9 and 10 and hammered at a top portion 123 to form a contact 125. As shown in FIG. 11, the contact 125 is substantially in the center of the resilient contact piece 120 and substantially extends in a width direction of the contact piece 120. The contact 125 is shorter than the width of the resilient contact piece 120 and the opposite ends thereof are arcuate (indicated by R in FIG. 11).

The resilient contact pieces 120 are formed on three surfaces of the shell main body 110, but not on the right wall 113. Specifically, two resilient contact pieces 120A, 120B are formed on the upper wall 111, two resilient contact pieces 120C, 120D are formed on the lower wall 112 and one resilient contact piece 112 is formed on the left wall 114. Thus, five resilient contact pieces 120 are formed in the entire shell main body 100.

The resilient contact pieces 120A, 120B on the upper and lower walls 111 and 112 substantially face each other and are in a vertically symmetrical relationship. The resilient contact pieces 120A, 120D are wide. The resilient contact pieces 120B, 120C are narrower, preferably less than ⅔ as wide, and particularly about half as wide as the resilient contact pieces 120A, 120D.

Stoppers 127 are formed on the respective walls 111 to 114 of the shell main body 110 at positions corresponding to the resilient contact pieces 120 (reference numeral 120 is a collective term of 120A to 120E). The stoppers 127 are formed by cutting and bending the respective walls 111 to 114 and function to prevent excessive deformations of the resilient contact pieces 120.

The shield shell 100 is assembled into the terminal mounting portion 41 of the housing 40 from behind. The shield shell 100 has a lock piece 119 that engages a receiving portion (not shown) formed in the housing 40 to retain the shield shell 100 when the shield shell 100 is inserted to a front stop position shown in FIG. 14.

The shield pieces 115 formed on the shell main body 110 pass through the communication holes 69 in the mounting flange 61 and project into the receptacle 55 to surround around the male terminals 31 when the shield shell 100 is at the front stop position. The resilient contact pieces 120 formed on the shell main body 110 have lateral sides at least partly surrounded by the protection walls 70 and have leading ends 121 accommodated in accommodating portions 67 formed in a rear surface 61B of the mounting flange 61. The constructions of the accommodating portions 67 and the protection walls 70 are described below.

Figure 15:
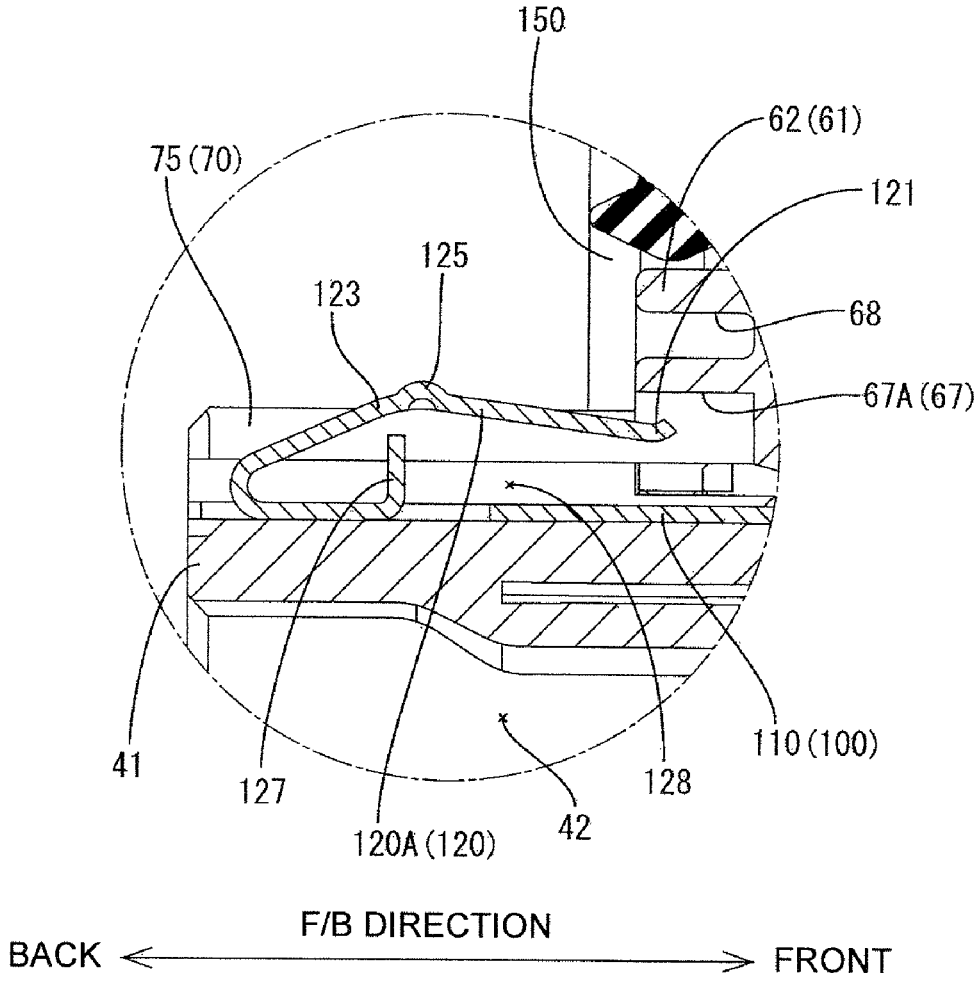
FIG. 15 is an enlarged view enlargedly showing a part (around a resilient contact piece) of FIG. 14.

As shown in FIG. 15, each accommodating portion 67 is a recess with an open rear end and formed to receive the leading end 121 of the resilient contact piece 120 from behind. Five accommodating portions 67A to 67E are formed to accommodate the five resilient contact pieces 120A to 120E.

Figure 12:
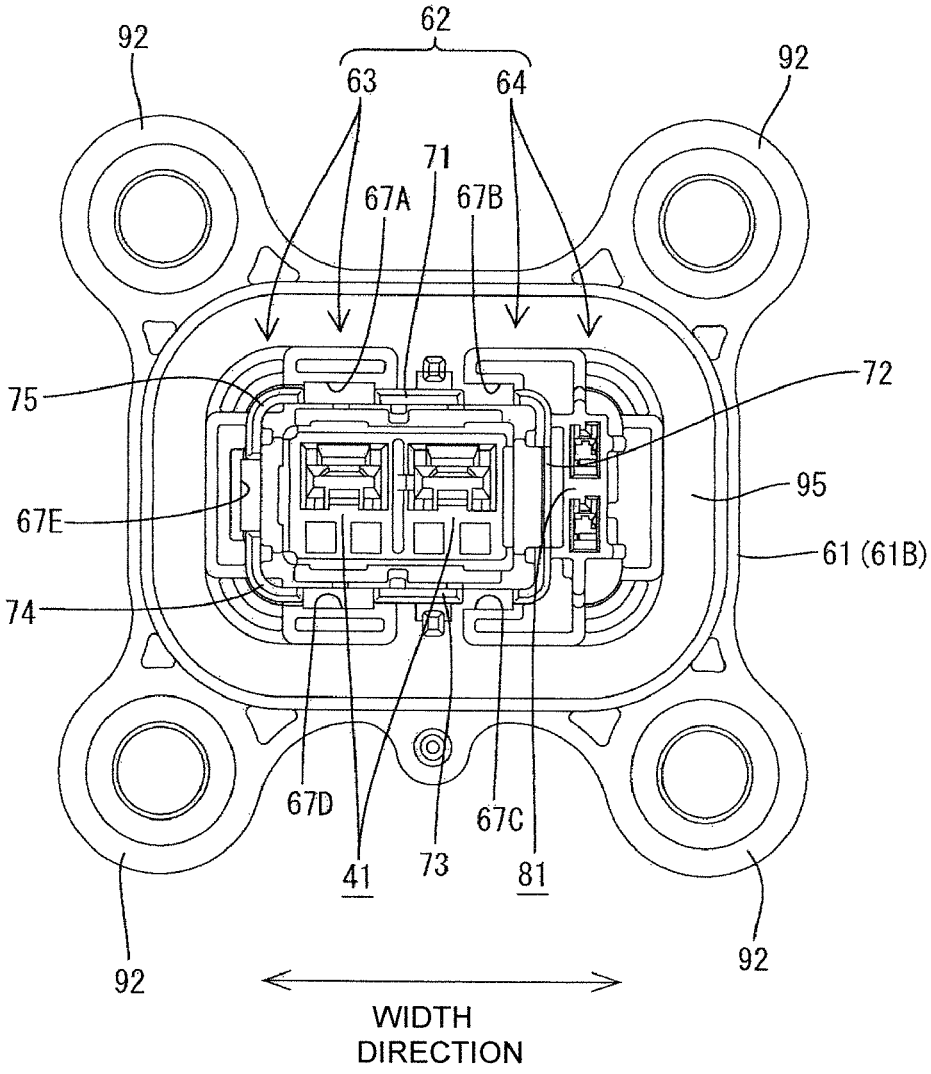
FIG. 12 is a rear view of only a housing.
Figure 13:
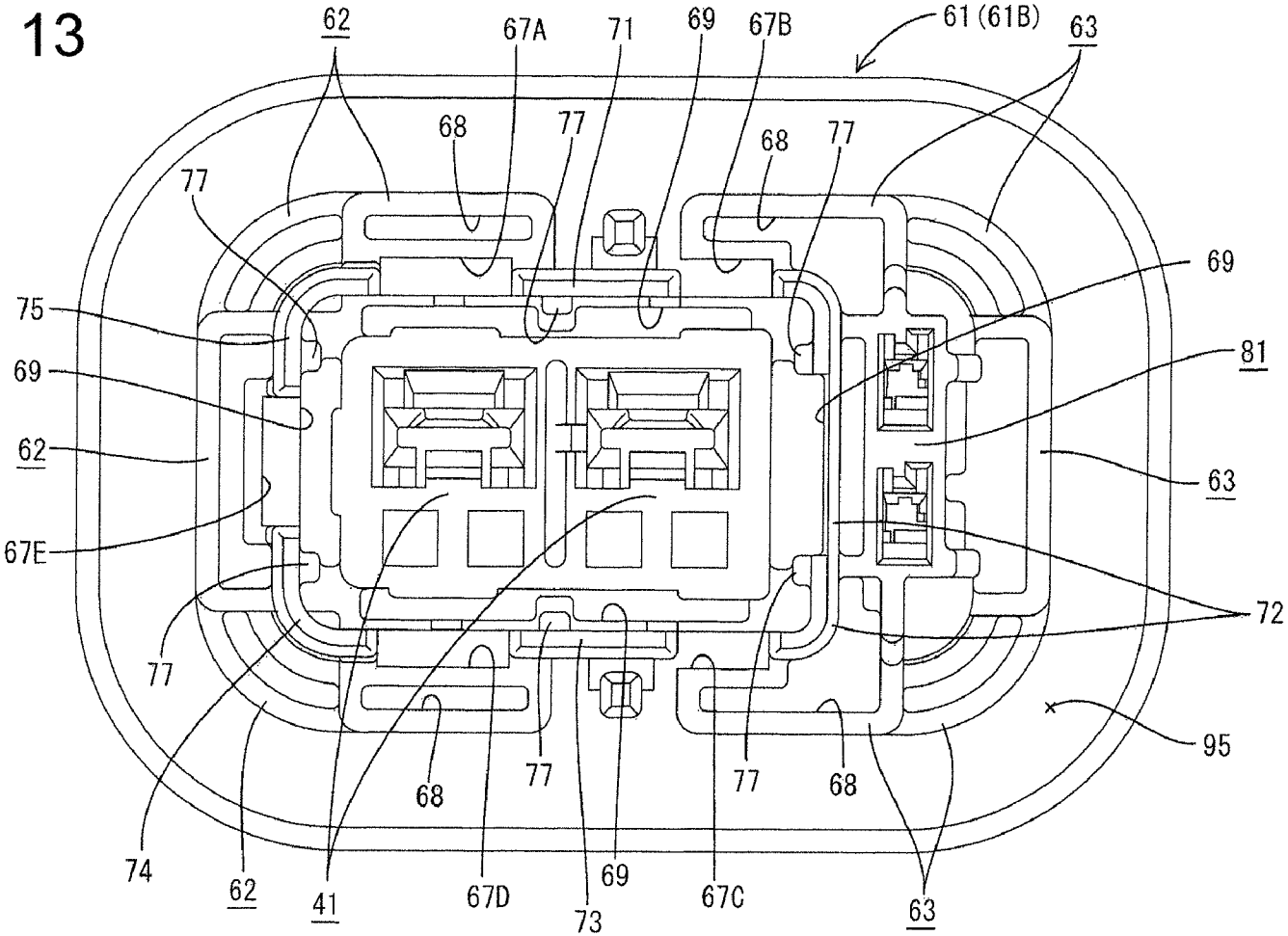
FIG. 13 is an enlarged diagram of FIG. 12.

An annular mounting groove 95 and a base portion 62 located at the inner side of the mounting groove 95 are formed in and on the rear surface 61B of the mounting flange 61. As shown in FIGS. 12 and 13, the base portion 62 has a size as to surround the terminal mounting portion 41 and the auxiliary terminal mounting portion 81 and is divided into a left base portion 63 and a right base portion 64.

Three accommodating portions 67A, 67D and 67E are formed in the left base portion 63 and two accommodating portions 67B, 67C are formed in the right base portion 64. The accommodating portions 67A, 67B are formed laterally substantially side by side above the terminal mounting portion 41 (upper side in FIG. 13). The accommodating portion 67A is for accommodating the leading end 121 of the resilient contact piece 120A, and the accommodating portion 67B is for accommodating the leading end 121 of the resilient contact piece 120B.

The accommodating portions 67C, 67D are formed laterally substantially side by side below the terminal mounting portion 41 (lower side in FIG. 13). The accommodating portion 67C is for accommodating the leading end 121 of the resilient contact piece 120C, and the accommodating portion 67D is for accommodating the leading end 121 of the resilient contact piece 120D. The accommodating portion 67E is formed to the left of the terminal mounting portion 41 (left side in FIG. 13) for accommodating the leading end 121 of the resilient contact piece 120E.

The base portions 63, 64 are formed with one or more bores 68 located at outer sides of the respective accommodating portions 67A to 67E. The bores 68 are recesses with an open rear side similar to the respective accommodating portions 67A to 67E.

The protection walls 70 are formed on the rear surface 61B of the mounting flange 61 and on the base portions 63, 64. The protection walls 70 are composed of five protection walls 71 to 75. All of the protection walls 71 to 75 extend back from the base portion 63 or 64 and the rear ends thereof reach the rear end surface 46 of the terminal mounting portion 41. These five protection walls 71 to 75 are arranged around the terminal mounting portion 41 while avoiding mounted positions of the resilient contact pieces 120 and at least partly surround lateral sides of the resilient contact pieces 120.

Figure 2:
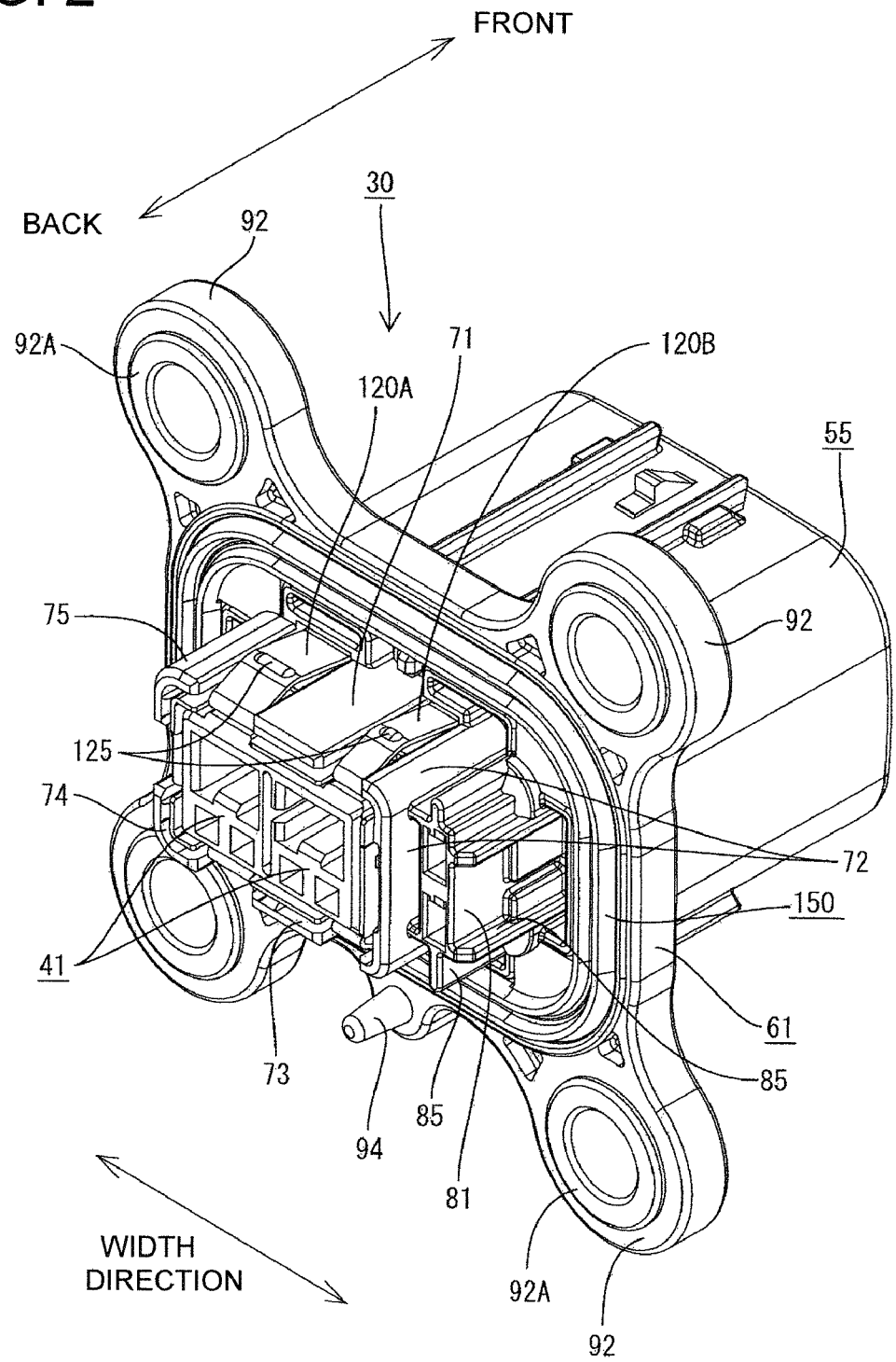
FIG. 2 is a perspective view of the shield connector.
Figure 6:
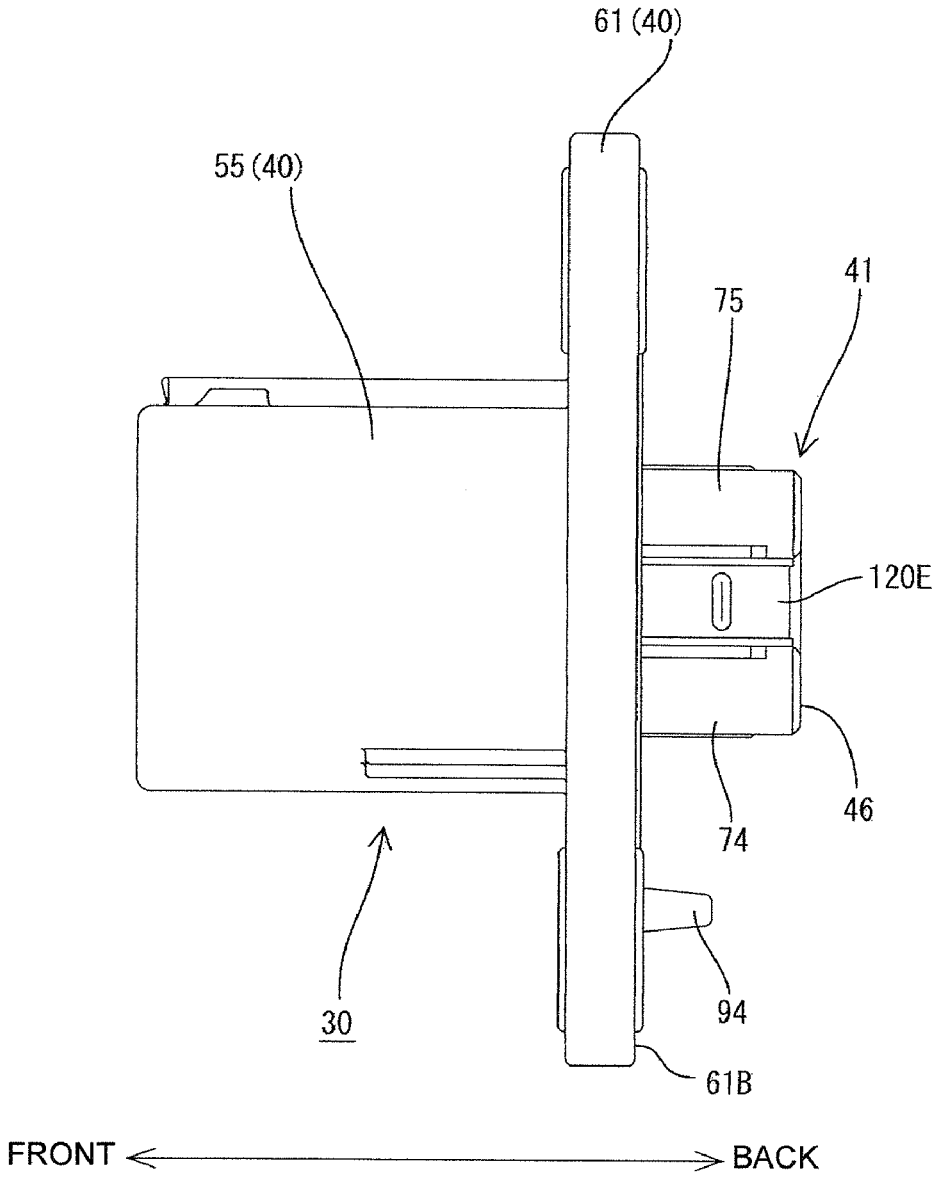
FIG. 6 is a side view of the shield shell when viewed in a direction B of FIG. 4.
Figure 7:
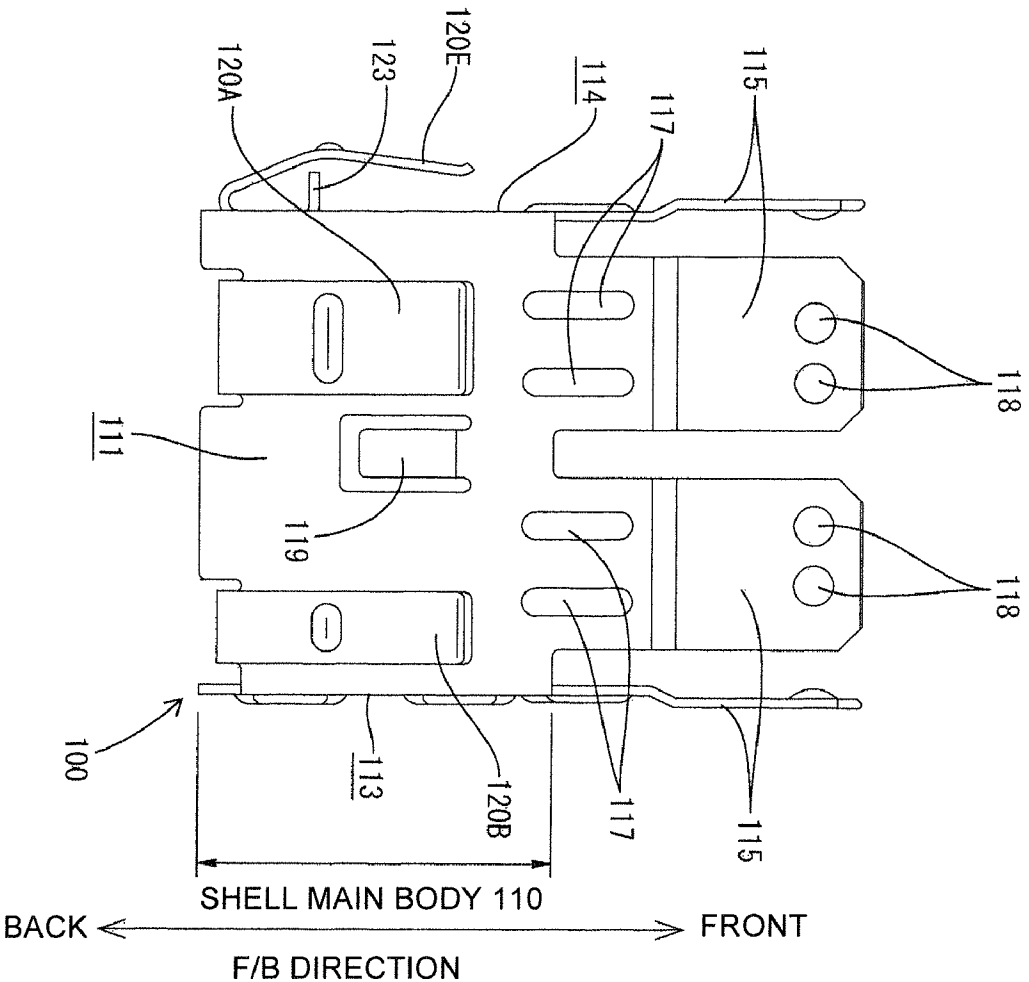
FIG. 7 is a plan view of the shield shell.
Figure 8:
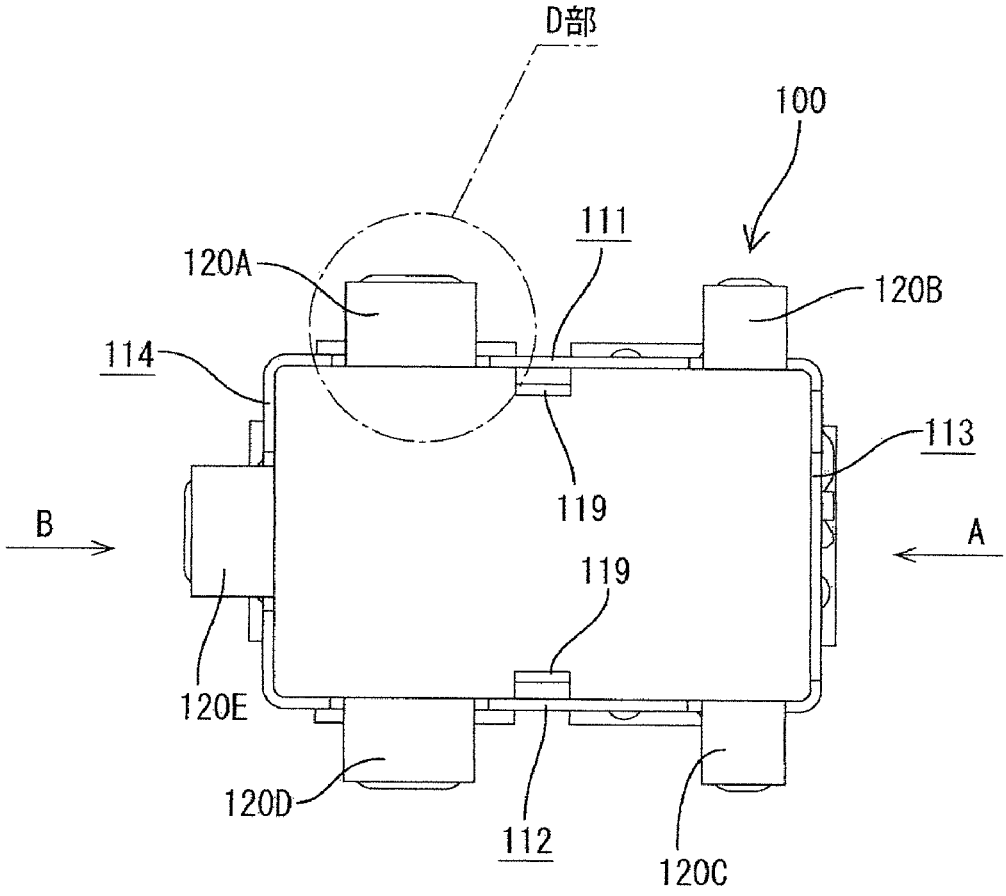
FIG. 8 is a rear view of the shield shell.

As shown in FIGS. 2 and 3, the resilient contact piece 120A is surrounded by the protection walls 75, 71 at the opposite left and right sides thereof, and the resilient contact piece 120B is surrounded by the protection walls 71, 72 at the opposite left and right sides thereof. Further, as shown in FIGS. 2 and 6, the resilient contact piece 120E is surrounded by the protection walls 74, 75 at the opposite upper and lower sides thereof.

As shown in FIG. 13, the protection wall 71 is a horizontal plate extending along a central part of the upper surface of the terminal mounting portion 41. The protection wall 72 is a vertically long plate extending over substantially the entire height of the right surface of the terminal mounting portion 41. Inwardly curved flanges surround corners of the terminal mounting portion 41 at opposite upper and lower edges of the protection wall 72, so that the protection wall 72 surrounds the right surface of the terminal mounting portion 41 over substantially the entire height. The protection wall 73 is a horizontal plate extending along a central part of the lower surface of the terminal mounting portion 41. The protection wall 74 has an L shape to surround a lower corner of the left surface of the terminal mounting portion 41, and the protection wall 75 has an L shape to surround an upper corner of the left surface of the terminal mounting portion 41.

The respective protection walls 71 to 75 overlap the top portions 123 of the resilient contact pieces 120. Specifically, the protection wall 70 vertically overlaps the top portion 123 of the resilient contact piece 120, as shown in FIG. 15 and only the contact 125 projects from the upper surface of the protection wall 70.

Figure 16:
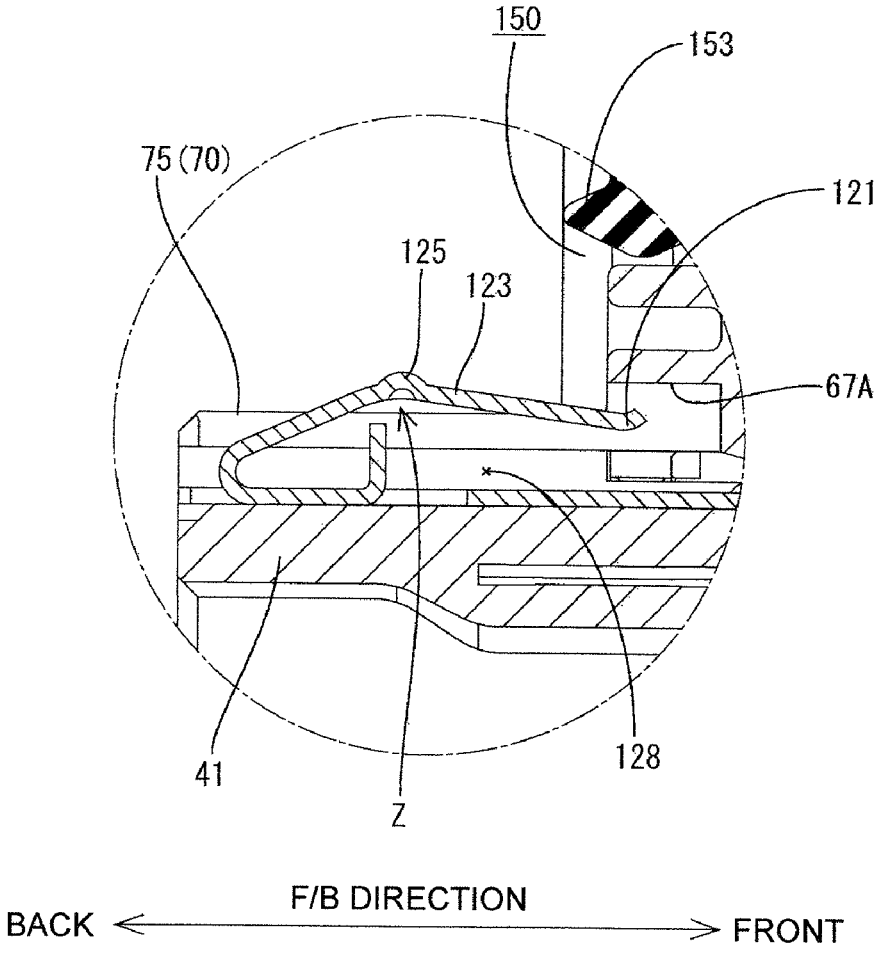
FIG. 16 is a diagram showing a comparative example.

If the position of the protection wall 70 is lower than that in FIG. 15 and the protection wall 70 should cross below the top 123 of the resilient contact piece 120 as shown in FIG. 16, a clearance Z would be formed below the top 123. However, with the construction of this embodiment, such a clearance Z is not formed.

Figure 14:
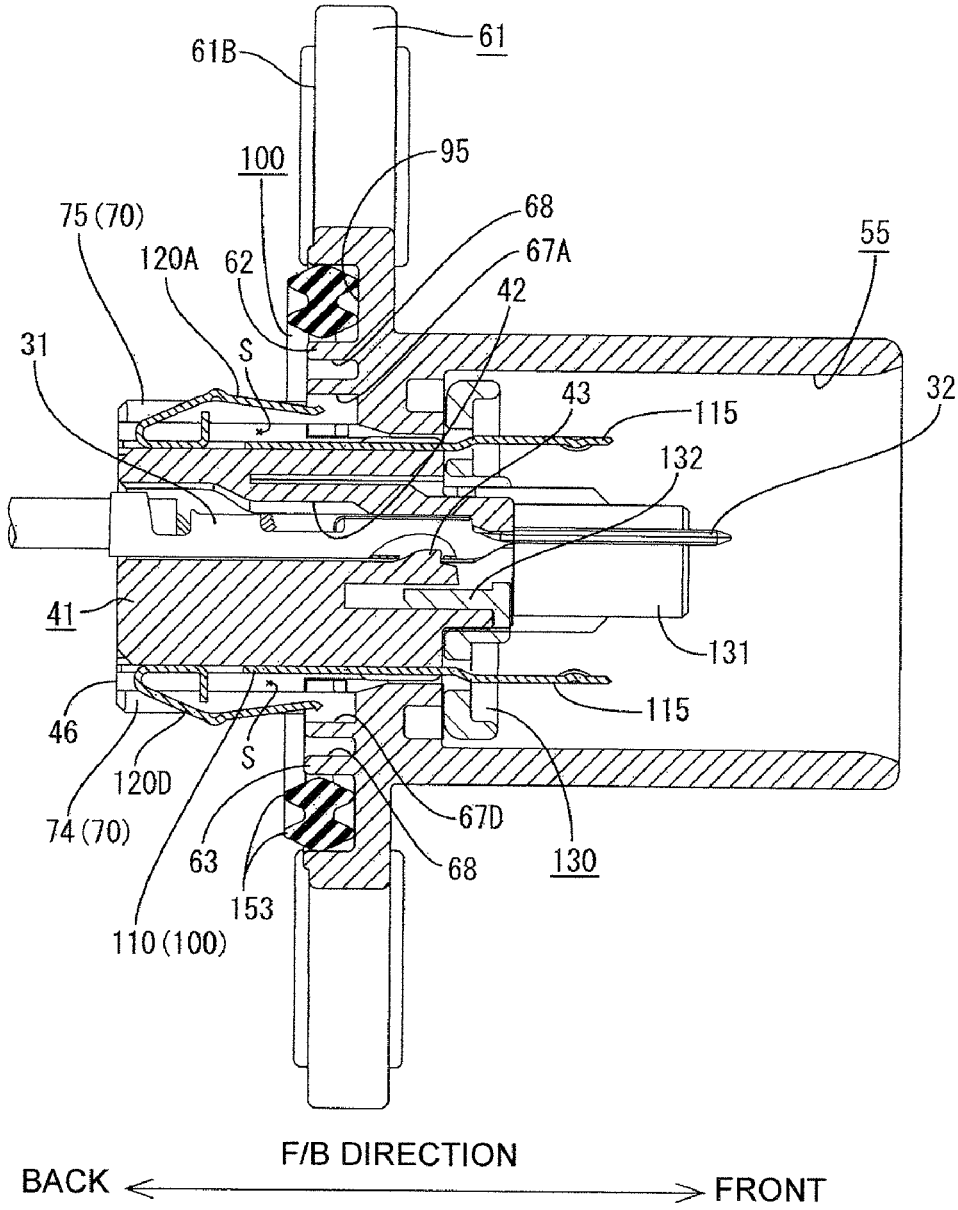
FIG. 14 is a section along C-C of FIG. 4 showing the shield connector.
Figure 17:
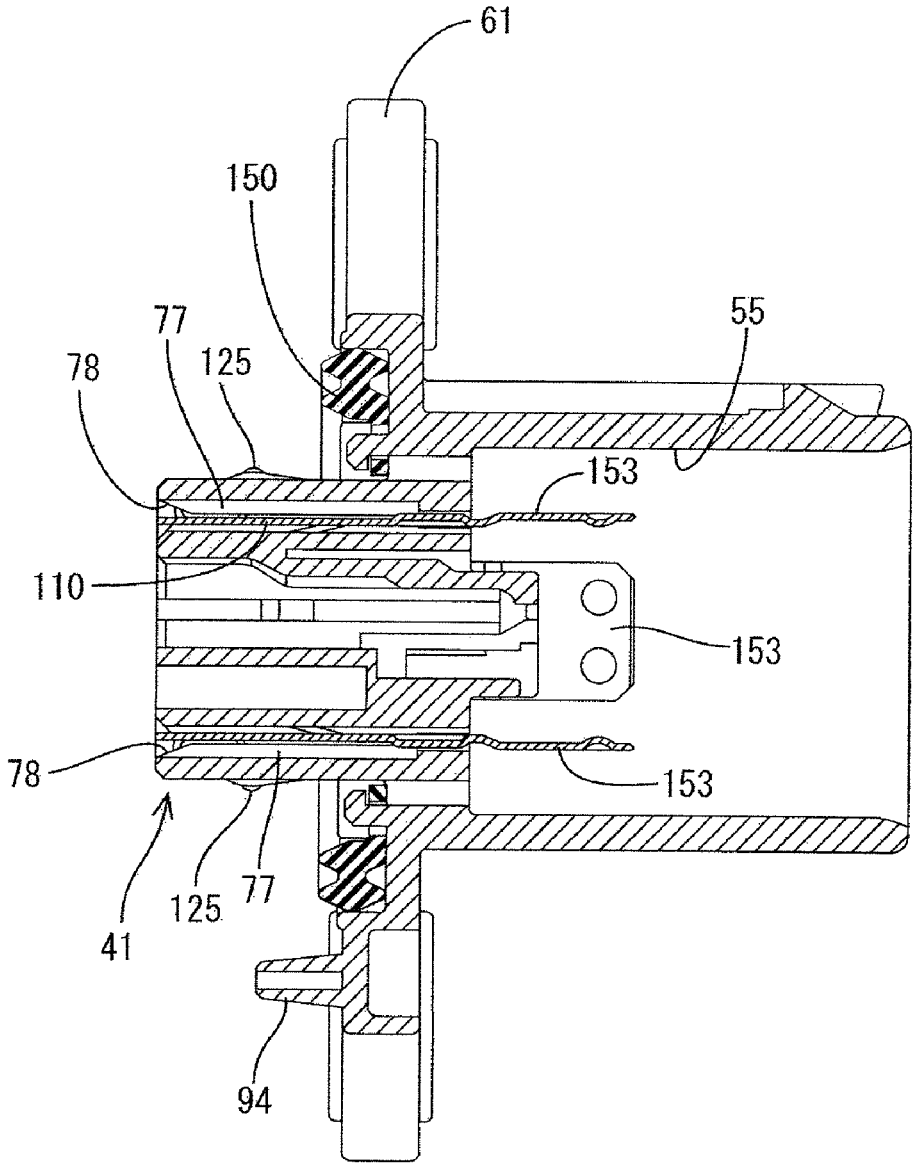
FIG. 17 is a section along E-E of FIG. 4 showing the shield connector.
Figure 18:
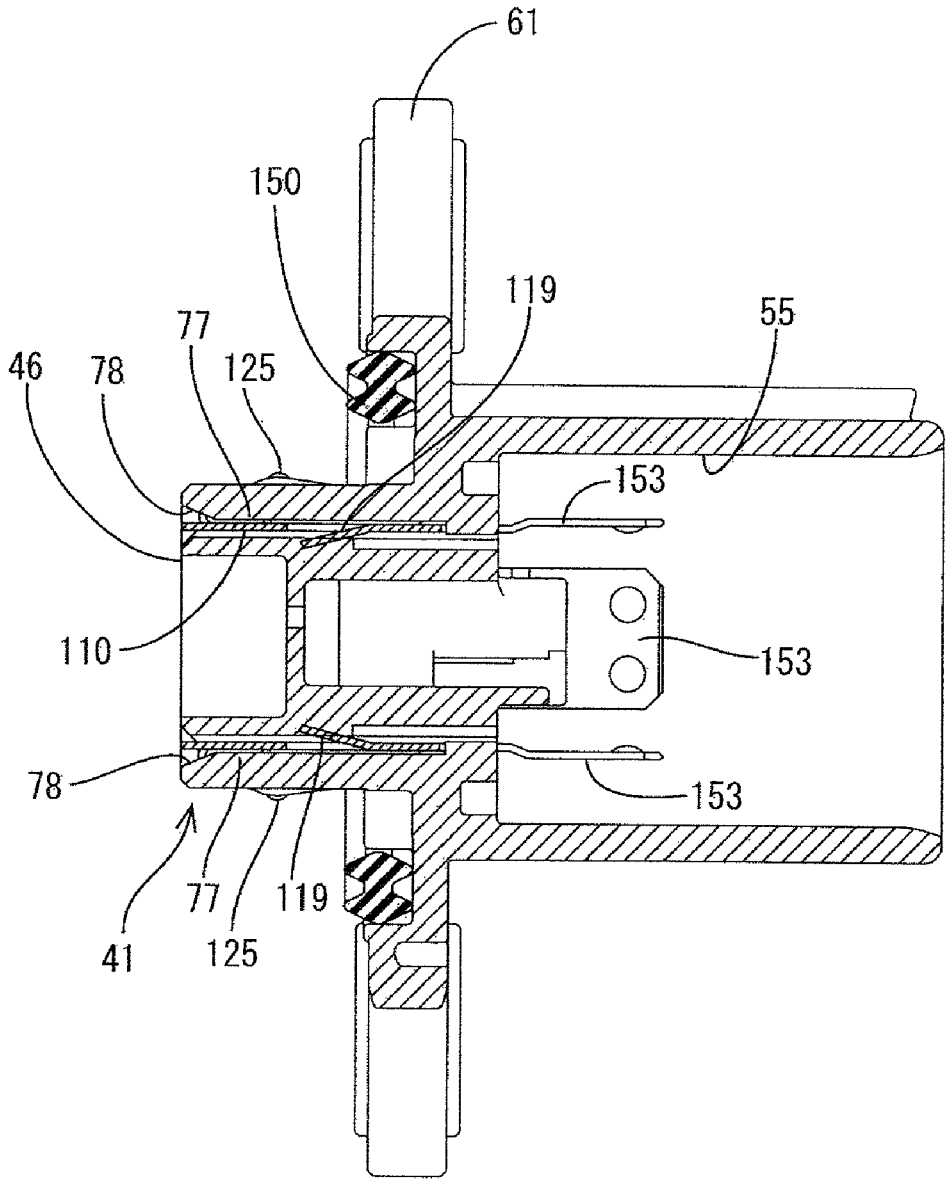
FIG. 18 is a section along F-F of FIG. 4 showing the shield connector.

The respective protection walls 71 to 75 define substantially constant clearances S between themselves and the outer circumferential surface of the terminal mounting portion 41 as shown in FIG. 14. The clearances S define insertion spaces for the shell main body 110 being mounted into the terminal mounting portion 41. As shown in FIGS. 17 and 18, elongated projections 77 project in on the inner surfaces of the respective protection walls 71 to 75.

Figure 19:
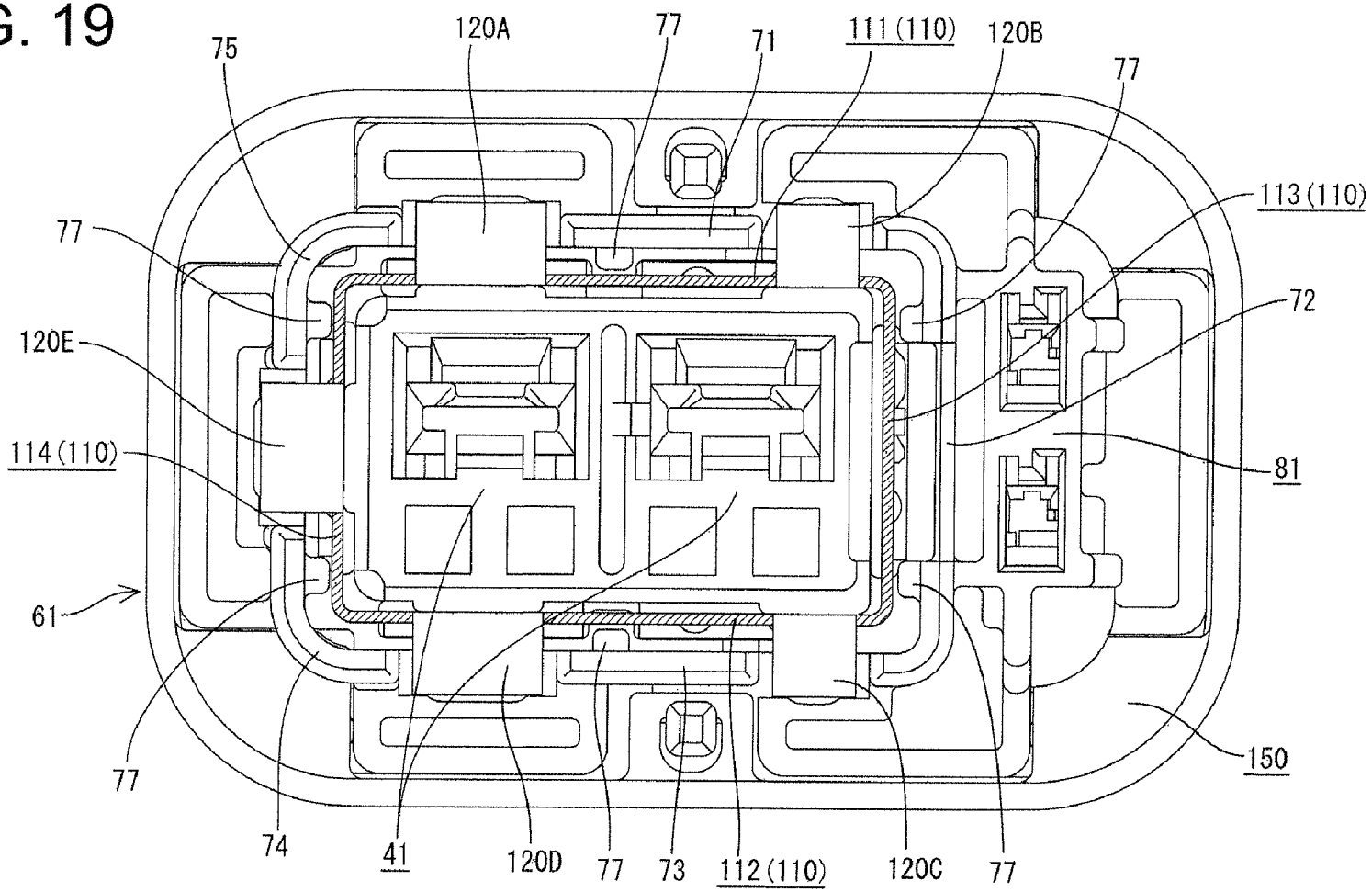
FIG. 19 is an enlarged view of FIG. 4.

The elongated projections 77 are formed over substantially the entire lengths of the protection walls 71 to 75. Additionally, the elongated projections 77 substantially vertically or horizontally face each other while defining minimum clearances necessary for assembling to respective four wall surfaces (shown by hatching in FIG. 19) 111 to 114 of the shell main body 110 as shown in FIG. 19. Thus, the shell main body 110 has its position restricted so as not to be inclined with respect to the terminal mounting portion 41.

A taper 78 is formed at the rear end of each elongated projection 77, so that the shield shell 100 can be assembled smoothly into the terminal mounting portion 41.

The mounting groove 95 is formed in the rear surface 61B of the mounting flange 61 and around the base portion 62. The mounting groove 95 is a closed annular groove to surround around the base portion 62, and a seal ring 150 is mounted therein. The seal ring 150 is made of a resilient material (such as rubber) and has an annular shape particularly slightly larger than the outer peripheral shape of the base portion 62. Annular lips 153 are formed on the each of the front and rear sides of the seal ring 150. This seal ring 150 functions to seal around the shaft hole 23 by resiliently contacting the wall surface around the shaft hole 23 of the mounting wall 20 when the shield connector 30 is mounted on the mounting wall 20.

Next, an assembling procedure of the shield connector 30 onto the mounting wall 20 of the housing case U is described. Here, it is assumed that the one or more male terminals 31 already are mounted into the shield connector 30.

To assemble the shield connector 30 on the mounting wall 20, the shield connector 30 first is positioned so that the terminal mounting portion 41 is in front of the shaft hole 23 while the terminal mounting portion 41 faces the mounting wall 20. The terminal mounting portion 41 then is inserted into the shaft hole 23 while the wires 35 connected to the respective male terminals 31 are inserted through the shaft hole 23.

In this way, the resilient contact pieces 120 are inserted into the shaft hole 23 with the leading ends in the lead. The shield connector 30 is fit further so that the tops 123 of the resilient contact pieces 120 enter the shaft hole 23 and contact surfaces 24 of the shaft hole 23. The resilient contact pieces 120 then are urged in by the surfaces 24 of the shaft hole 23 and resiliently deform with folds at the leading ends as base points.

The mounting flange 61 contacts and overlaps with the edge of the shaft hole 23 at this position to complete the fitting operation.

The resilient contact pieces 120 are formed on three walls of the shell main body 110 are held resiliently in contact with three of the hole walls 24 of the shaft hole 23. Specifically, the contacts 125 of the resilient contact pieces 120A to 120D on the upper and lower walls 111, 112 of the shell main body 110 are held resiliently in contact with the upper and lower surfaces 24 of the shaft hole 23. Further, the contact pieces 85 of the auxiliary terminal mounting portion 81 are held in contact with the left surface 24 of the shaft hole 23, and the contact 125 of the resilient contact piece 120E formed on the left wall 114 of the shell main body 110 is held resiliently in contact with the right surface 24 of the shaft hole 23. Thus, the shell main body 110 is grounded to the mounting wall 20.

Bolts B1 then are inserted through the bolt insertion holes 93 of the mounting flange 61 and screwed into the respective bolt holes 27 of the mounting wall 20. The bolt tightening operation at four positions fastens the mounting flange 61 at four sides to an edge of the shaft hole 23 to fix the shield connector 30 on the mounting wall 20.

Figure 20:
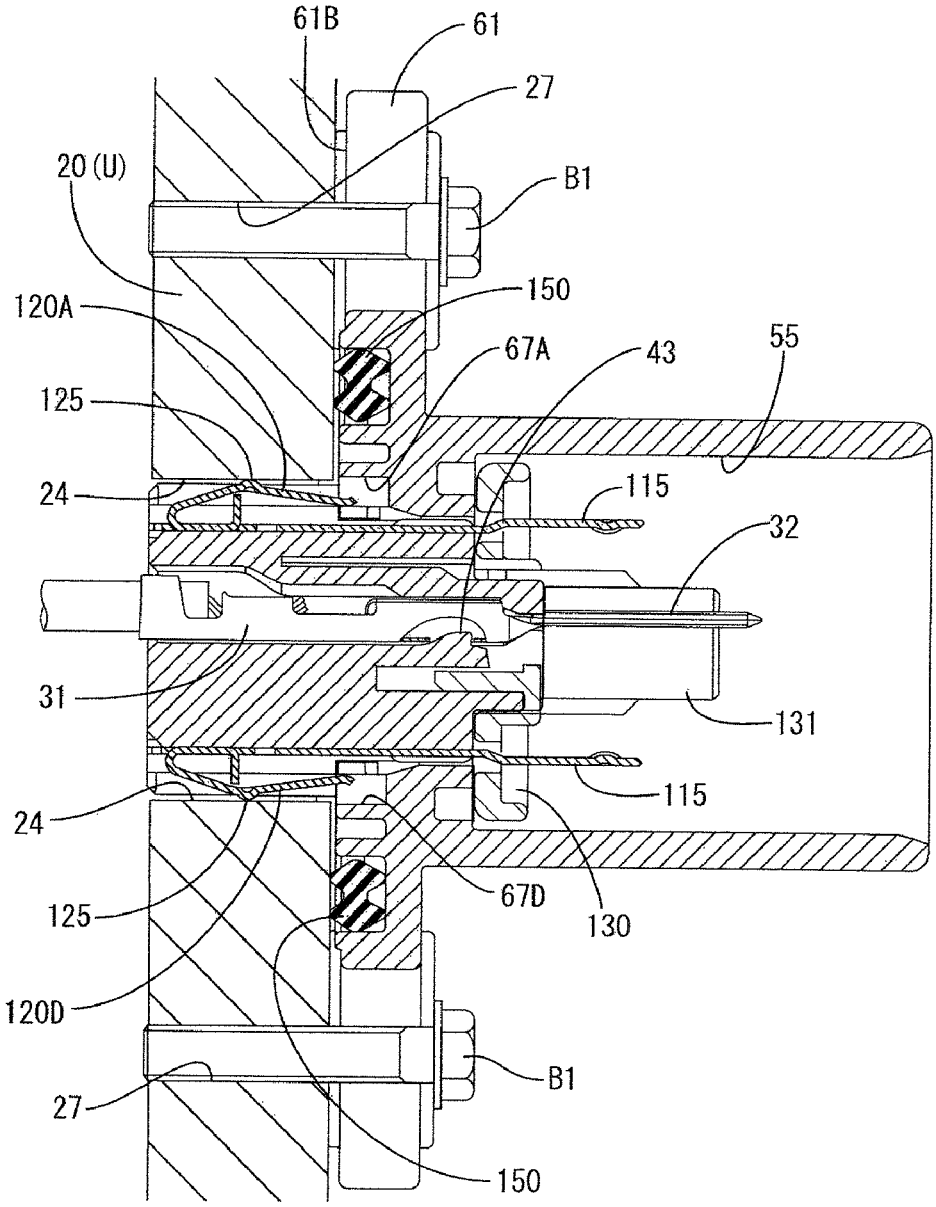
FIG. 20 is a section showing a mounting structure of the shield connector onto a mounting wall.

The seal ring 150 of the shield connector 30 is sandwiched and compressed between the edge of the shaft hole 23 and the rear surface 61B of the mounting flange when the assembly is complete 61, as shown in FIG. 20. This causes the lips 153 of the seal ring 150 to be held resiliently in contact with the edge of the shaft hole 23 and the rear surface 61B of the mounting flange 61. Thus, a joined part of the shield connector 30 and the housing case U is sealed completely over the entire periphery.

The mating connector (not shown) may be fit into the receptacle 55 of the shield connector 30 after the shield connector 30 is assembled onto the mounting wall 20. The mating connector is a shield connector and includes a tubular shield shell (not shown) similar to the shield shell 100. Thus, the shield shells of both connectors come into contact when the mating connector is fit into the receptacle 55 of the shield connector 30. This contact grounds the shield shell of the mating connector and outer conductors of shield cables to the mounting wall 20 and the shield shell 100. Note that such a grounding structure also is disclosed in Japanese Unexamined Patent Publication No. 2008-41600 filed by the present applicant, the disclosure of which is included herein by reference.

Leading ends 121 of the resilient contact pieces 120 are accommodated in the accommodating portions 67 in the mounting flange 61 (see FIG. 15). Thus, there is no likelihood that the leading ends 121 of the resilient contact piece 120 will be caught by surrounding interfering objects when the shield connector 30 is carried around and assembled (e.g. during an operation of mounting the male terminals 31 into the housing 40, an operation of fixing the connector 30 to the mounting wall 20, etc.). Therefore, there is no likelihood that excessive forces will act on the leading ends 121 to damage and/or deform the resilient contact pieces 120.

The protection walls 71 to 75 surround and block the lateral sides of the respective resilient contact pieces 120. Thus, there is no likelihood that foreign matter, such as an unlocking jig, enters the deformation spaces 128 for the resilient contact pieces 120A to 120E. More particularly, the protection walls 71 to 75 overlap the top portions 123 of the resilient contact pieces 120, so that entry of a foreign matter into the deformation spaces 128 can be substantially reliably eliminated. If the leading end of the unlocking jig should enter the deformation space 128, an excessive force might damage and/or deform the resilient contact piece 120 during an attempt to bring this leading end out. However, in this embodiment, there is no such likelihood.

The position and posture of the shell main body 110 are restricted and controlled by the elongated projections 77 formed on the inner surfaces of the protection walls 70. Thus, the shell main body 110 can be mounted into the terminal mounting portion 41 without any position or posture shifts. With such a construction, the contacts 125 of the resilient contact pieces 120 can be held stably in contact with the surfaces 24 of the shaft hole 23. Therefore a contact pressure of the resilient contact pieces 120 with the surfaces 24 equal to or higher than a predetermined value can be ensured.

The ends of the contacts 125 on the resilient contact pieces 120 are arcuate. With such a construction, even if the shield connector 30 rotates somewhat relative to the shaft hole 23 when a bolt tightening operation is performed to fix the shield connector 30 in the shaft hole 23, the resilient contact pieces 120 are held stably in contact with the surfaces 24 of the shaft holes 23 by the arcuate surfaces R as shown in FIG. 11.

The present invention is not limited to the above described and illustrated embodiment. For example, the following embodiment is also included in the technical scope of the present invention.

Figure 21:
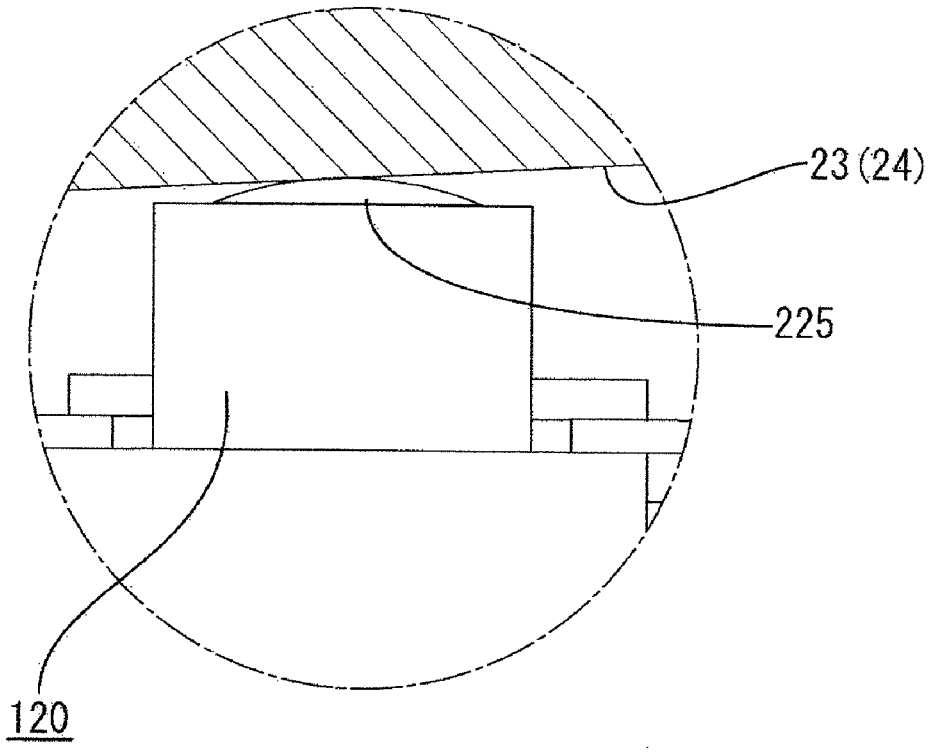
FIG. 21 is a diagram showing a modification.

In the above embodiment, opposite widthwise ends of the contacts 125 formed on the resilient contact pieces 120 are arcuate. Besides the shape illustrated in the above embodiment, the contacts 125 may, for example, be entirely arcuate as shown in FIG. 21.

What is claimed is:

1. A shield connector to be mounted onto a conductive mounting member formed with a shaft hole, comprising:

a housing including a terminal mounting portion and a mounting flange, an accommodating portion and protection walls formed in a rear surface of the mounting flange;

at least one terminal mounted in the terminal mounting portion; and a conductive shield shell including a substantially tubular shell main body for at least partly surrounding a terminal portion of the terminal and at least one resilient contact piece for resiliently contacting a surface of the shaft hole of the mounting member to ground the shell main body to the mounting member, the resilient contact piece being cantilevered from the shell main body and folded to extend forward and defining a deformation space between itself and the shell main body, the resilient contact piece including a leading end at least partly accommodated in the accommodating portion of the mounting flange, and sides of the resilient contact piece being disposed between two of the protection walls of the housing.

2. The shield connector of claim 1, wherein the housing includes a receptacle at a front side for receiving a mating connector, the mounting flange being between the terminal mounting portion and the receptacle, the terminal portion of the terminal projecting into the receptacle.

3. A shield connector of claim 1, wherein the resilient contact piece is folded near a rear edge portion of the shell main body to extend forward.

4. The shield connector of claim 3, wherein the protection walls at least partly overlap a top portion of the resilient contact piece.

5. A shield connector of claim 4, wherein a contact is formed on the top portion of the resilient contact piece for contacting a surface of the shaft hole of the mounting member.

6. The shield connector of claim 5, wherein the contact is arcuate.

7. The shield connector of claim 1, wherein the protection walls are plates defining substantially uniform clearances between the protection walls and the terminal mounting portion for permitting passage of the shell main body.

8. The shield connector of claim 1, wherein at least one elongated projection projects inwardly on the inner surface of the protection wall to restrict a position of the shell main body.

9. The shield connector of claim 8, wherein at least one taper is formed at or near the rear end of the elongated projection, so that the shield shell can be assembled smoothly into the terminal mounting portion.

10. The shield connector of claim 1, further comprising a stopper formed on the shell main body substantially in correspondence with the resilient contact piece to prevent an excessive deformation of the resilient contact piece.

11. The shield connector of claim 1, further comprising shield pieces on the shell main body and projecting through communication holes in the mounting flange and into the receptacle to at least partly surround the terminal.

12. The shield connector of claim 1, wherein the mounting flange has a mounting groove and a seal being mounted into the mounting groove.

13. The shield connector of claim 12, wherein the seal has annular lips for resiliently contacting a wall surface adjacent to the shaft hole of the mounting member when the shield connector is mounted on the mounting member.

14. The shield connector of claim 1, wherein shield pieces are formed at upper and lower walls of the shell main body at positions substantially facing each other and in a vertically symmetrical relationship, and at a right and left walls of the shell main body at positions substantially facing each other and in a bilaterally symmetrical relationship.

15. The shield connector of claim 1, wherein each of the shield pieces is formed with a step at an intermediate position, so that a leading end is offset outwardly by the step relative to a base end.

* * * * *